US008020472B2

(12) United States Patent
Kelly et al.

(10) Patent No.: US 8,020,472 B2
(45) Date of Patent: Sep. 20, 2011

(54) NUT CAPTURING SOCKET ASSEMBLY

(76) Inventors: Michael W. Kelly, Joliet, IL (US); Laura Patterson, Joliet, IL (US); Douglas John Francis, Sr., Wilmington, IL (US)

( * ) Notice: Subject to any disclaimer, the term of this patent is extended or adjusted under 35 U.S.C. 154(b) by 329 days.

(21) Appl. No.: 12/429,602

(22) Filed: Apr. 24, 2009

(65) Prior Publication Data

US 2010/0269643 A1 Oct. 28, 2010

(51) Int. Cl.
*B25B 13/02* (2006.01)

(52) U.S. Cl. ..... 81/125; 81/13; 81/180.1

(58) Field of Classification Search ..... 81/125, 81/180.1, 184, 13, 124.1
See application file for complete search history.

(56) References Cited

U.S. PATENT DOCUMENTS 3,005,367 A 10/1961 Vose
5,323,673 A 6/1994 Martinez et al.
5,640,889 A 6/1997 Anderson
6,634,261 B1 10/2003 Griffin
7,243,579 B2 * 7/2007 Hennessey et al. ..... 81/125
2009/0019973 A1 * 1/2009 Nieh ..... 81/124.1

* cited by examiner

*Primary Examiner* — D S Meislin
(74) *Attorney, Agent, or Firm* — Greer, Burns & Crain, Ltd.

(57) ABSTRACT

A nut capturing socket assembly includes a socket, an inner sleeve and an outer sleeve. The socket has a non-circular shaped interior opening to receive a nut and a circular cylindrical outer surface area. The inner sleeve has a circular cylindrical opening at one end sized to slidingly receive the socket. The inner sleeve has a non-circular shaped opening at an opposite end of the same size and configuration as the non-circular shaped interior opening of the socket. A first abutment element is fixed relative to the socket and a second abutment element is fixed relative to the inner sleeve. An elastic element is positioned between the first and second abutment elements to bias the inner sleeve rotationally relative to the socket. The outer sleeve surrounds the inner sleeve is sized to engage the inner sleeve to co-rotate therewith. The outer sleeve captures the elastic element internally of the socket assembly. All of the components of the socket assembly are permanently assembled together such that no components can become detached from one another.

18 Claims, 5 Drawing Sheets

NUT CAPTURING SOCKET ASSEMBLY

BACKGROUND OF THE INVENTION

The present invention relates to tools used for attaching and removing nuts from bolts or threaded studs.

Sockets for use in attaching and removing nuts are well known. In most constructions, the socket has a non-circular opening, such as a hex-shaped opening for receiving the nut. The nut is free to move into and out of the opening. While such an arrangement allows for ease of engaging the socket with the nut, it also allows for unintentional dislodgment of the nut from the socket. In some work environments, the unintentional dislodgement of the nut from the socket can lead to serious problems, particularly if the nut falls into an area that is inaccessible, yet would cause damage if allowed to remain in that area when the operation of machinery is continued or resumed.

It is known to provide arrangements for capturing a nut within a socket, such as the arrangements disclosed in U.S. Pat. Nos. 3,005,367; 5,323,673; 5,640,889; and 6,634,261. Typically such systems utilize a movable element, such as a spring loaded ball, to press against or interfere with the nut to capture the nut. An axial force is required to be applied to the nut to overcome the radial force of the movable element to release the capture.

SUMMARY OF THE INVENTION

In an embodiment of the invention, a nut capturing socket assembly is provided which is comprised of a socket, an inner sleeve and an outer sleeve. The socket has a non-circular shaped interior opening and a circular cylindrical outer surface area with a first, outer diameter. The inner sleeve has a circular cylindrical opening at one end of the sleeve with a second, inner diameter sized to slidingly receive the circular cylindrical outer surface area of the socket and a non-circular shaped opening at an opposite end of the sleeve of substantially the same size and configuration as the non-circular shaped interior opening of the socket. The inner sleeve has an outer surface. A first abutment element is fixed relative to the socket. A second abutment element is fixed relative to the inner sleeve. An elastic element is positioned between the first and second abutment elements. The outer sleeve surrounds at least a portion of the inner sleeve and has an inner surface sized to interferingly engage a portion of the inner sleeve outer surface.

In another embodiment of the invention, a nut capturing socket assembly is provided which is comprised of a socket, an inner sleeve and an outer sleeve. The socket has a non-circular shaped interior opening and a circular cylindrical outer surface with a first, outer diameter. The inner sleeve has a circular cylindrical opening at one end of the inner sleeve with a second, inner diameter sized to slidingly receive the first, outer diameter of the socket and a non-circular shaped opening at an opposite end of the inner sleeve substantially the same size and configuration as the non-circular shaped interior opening of the socket. The inner sleeve has an outer surface, the inner sleeve outer surface including at least one groove formed therein extending in a circumferential direction. At least a portion of the groove has a depth equal to a thickness of the inner sleeve. A pin extends into a blind hole in the socket and into the groove. A spring is carried in the groove to abut against one end of the groove at one end and to abut against the pin at the other end. The outer sleeve surrounds at least a portion of the inner sleeve and has an inner surface sized to interferingly engage with a portion of the inner sleeve outer surface.

In an embodiment of the invention, a nut capturing socket assembly is provided which comprises a socket, an inner sleeve and an outer sleeve. The socket has a hexagonally shaped interior opening and a circular cylindrical outer surface with a first, outer diameter. The inner sleeve has a circular cylindrical opening at one end with a second, inner diameter sized to slidingly receive the first, outer diameter of the socket and a hexagonally shaped opening at an opposite end of substantially the same size as the hexagonally shaped interior opening of the socket. The inner sleeve has a circular cylindrical outer surface with a third, outer diameter. The inner sleeve outer surface is knurled in an area extending substantially circumferentially around the inner sleeve outer surface. The inner sleeve outer surface includes two grooves formed therein, each groove extending in a circumferential direction around less than one half of a circumference of the inner sleeve. Both grooves lie generally in the same plane. At least a portion of each groove has a depth equal to the thickness of the inner sleeve. A pin extends into a blind hole in the socket and into the portion of the groove. A spring is carried in the groove to abut against one end of the portion of the groove at one end and to abut against the pin at the other end. An outer sleeve surrounds the inner sleeve and has a circular cylindrical inner surface with a fourth, inner diameter sized to interferingly engage the knurled outer surface area of the inner sleeve.

DETAILED DESCRIPTION OF THE PREFERRED EMBODIMENTS

Figure 1:
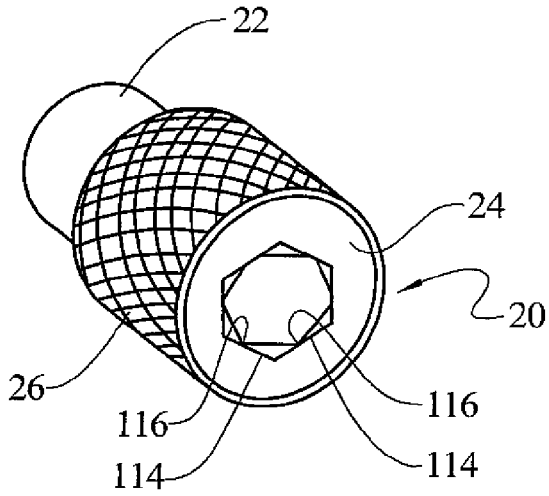
FIG. 1 is a front perspective view of socket assembly embodying the principles of the present invention.
Figure 2:
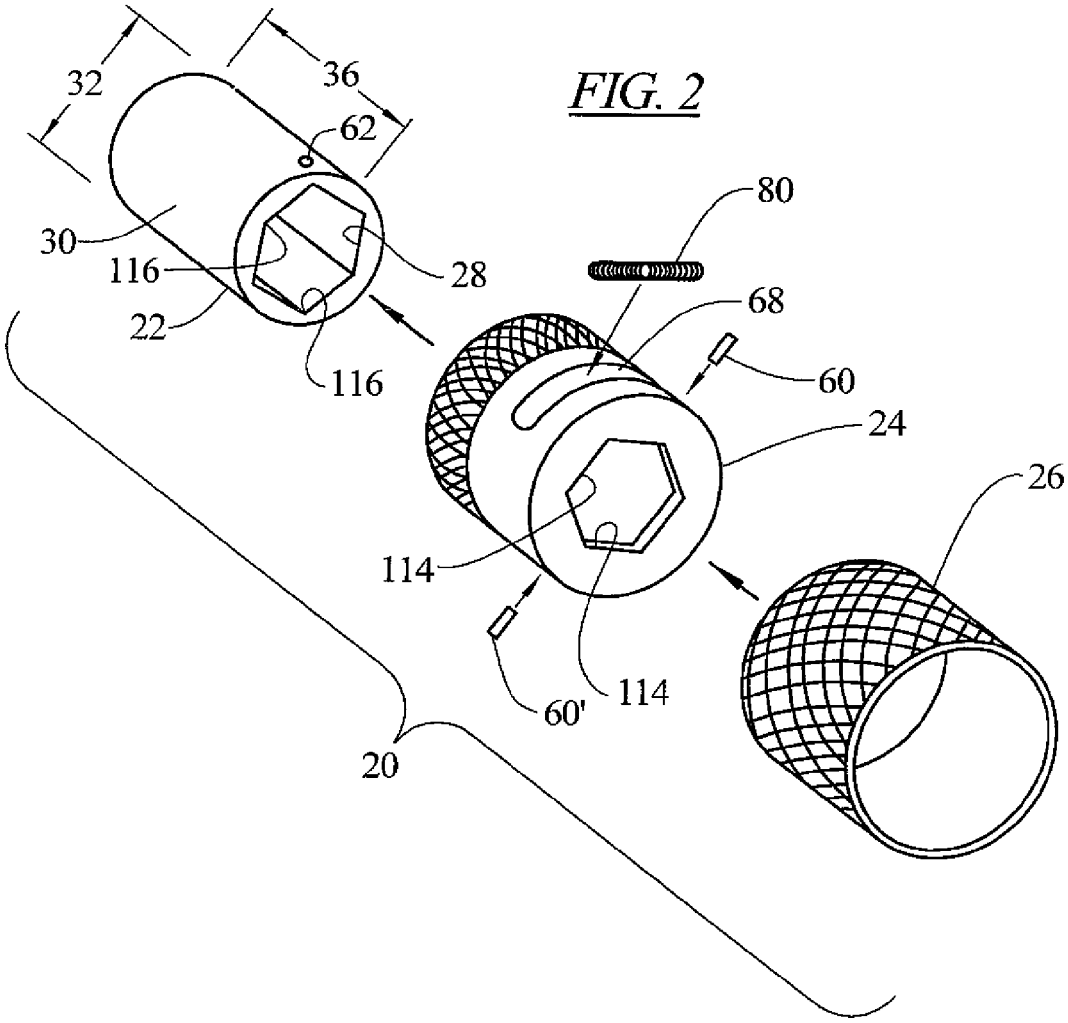
FIG. 2 is an exploded perspective view of the socket assembly of FIG. 1.
Figure 3:
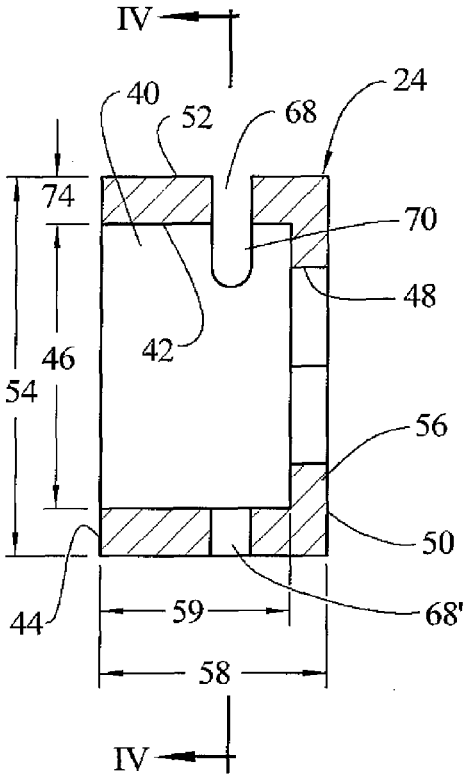
FIG. 3 is a side sectional view of the inner sleeve portion of the socket assembly of FIG. 1.

An embodiment of the invention is illustrated in the FIGS. although the present invention can take the form of other embodiments which may vary from the one illustrated. In FIGS. 1 and 2, a nut capturing socket assembly 20 is provided which is comprised of a socket 22, an inner sleeve 24 and an outer sleeve 26.

The socket 22 has a first non-circular shaped interior opening 28 and a circular cylindrical outer surface area 30 with a first, outer diameter 32. The non-circular shaped interior opening 28 may, in some embodiments, be hexagonal to receive a hexagonal shaped nut forming a portion of a bolt or being engaged on a threaded stud. The socket 22 may also have a second non-circular opening 34, such as a square opening, formed at an opposite end from the first non-circular opening to receive a driver tool, such as a ratchet wrench as is well known. Other types of driving surfaces, such as a non-circular exterior surface area, or a differently shaped non-circular opening, or holes for receiving a tool such as a spanner wrench, etc., may be provided on the socket 22. An axial length 36 of the socket 22 may be determined for a particular type or location of nut 39 (FIG. 9) that is to be turned with the socket, including short sockets having a length of less than an inch to deep sockets having a length of more than one inch to several inches.

The inner sleeve 24 may have a through passage 40 formed by a circular cylindrical opening 42 at one end 44 of the sleeve with a second, inner diameter 46 sized to slidingly receive the circular cylindrical outer surface area 30 of the socket 22. The inner sleeve 24 also has a non-circular shaped opening 48 at an opposite end 50 of the sleeve of substantially the same size and configuration as the non-circular shaped interior opening 28 of the socket 22. The inner sleeve 24 may have a circular cylindrical outer surface 52 with a third, outer diameter 54. Alternatively, the outer surface 52 may have a shape other than circular. The non-circular shaped opening 48 in the inner sleeve 24 is formed in an end wall 56 of the inner sleeve, the end wall having a thickness of preferably not more than 0.5 inches, but at least 0.0625 inches.

The inner sleeve 24 has an axial length 56 which is typically no greater than the axial length 36 of the socket 22, and may be shorter than the axial length of the socket.

A first abutment element 60 is fixed relative to the socket 22. The first abutment element 60 may comprise a projection, such as a pin, extending radially out from the outer surface area 30 of the socket 22. For example, a blind hole 62 may be formed in the outer surface area 30 of the socket 22 for frictionally receiving and retaining the pin 60.

A second abutment element 64 is fixed relative to the inner sleeve 24. The second abutment element 64 may comprise a radially extending wall formed in the inner sleeve. For example, the radially extending wall 64 may comprise an end wall of a groove 68 formed in the outer surface 52 of the inner sleeve 24. In such an embodiment, the groove 68 may extend in a circumferential direction with at least a first portion 70 of the groove having a depth equal to a thickness 74 of the inner sleeve 24. In such an embodiment, the first portion 70 of the groove 68 overlies the hole 62 formed in the outer surface area 30 of the socket 22 so that the pin 60 can be inserted into the hole after the inner sleeve 24 is slid over the socket. In the embodiment illustrated in the FIGs., the groove 68 extends circumferentially around less than half of the circumference of the outer surface of the inner sleeve 24. For example, the groove 68 may extend through an angle of approximately 90 degrees.

An elastic element 80 is positioned between the first 60 and second 64 abutment elements. In an embodiment, the elastic element 80 may comprise a spring carried in the groove 68 to abut against the end wall 64 of the groove at one end and to abut against the pin 60 at the other end. In the embodiment illustrated, a second groove 68' and a second pin 60' are provided, the two grooves 68, 68' each extending circumferentially around less than one half of the circumference of the outer surface area 30 of the inner sleeve 24 and generally lying in the same plane with each other. The second groove may extend through a smaller angle, such as 35 degrees.

Figure 4:
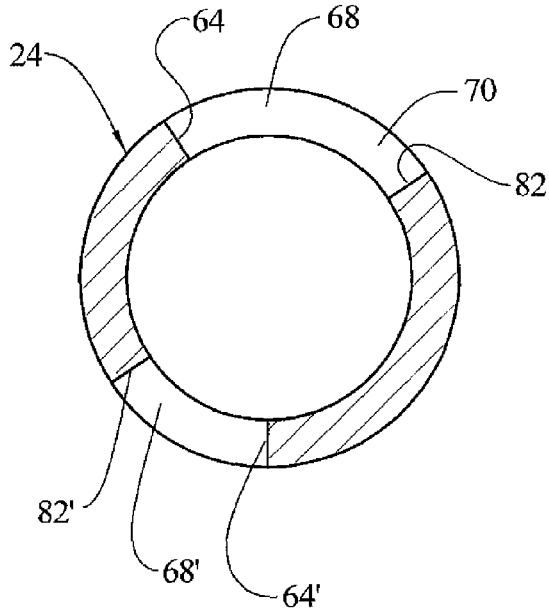
FIG. 4 is an end sectional view of the inner sleeve taken generally along the line IV-IV of FIG. 3.
Figure 5:
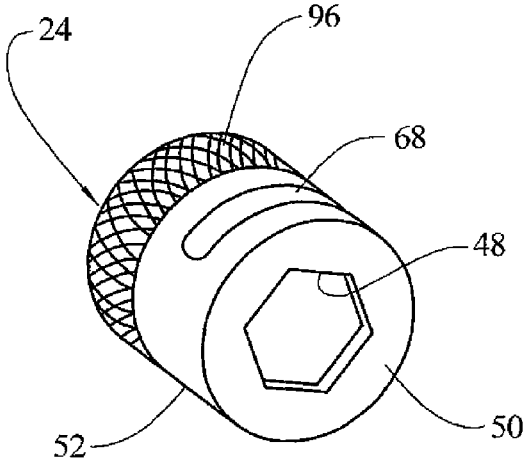
FIG. 5 is a front perspective view of the inner sleeve of FIG. 3.
Figure 6:
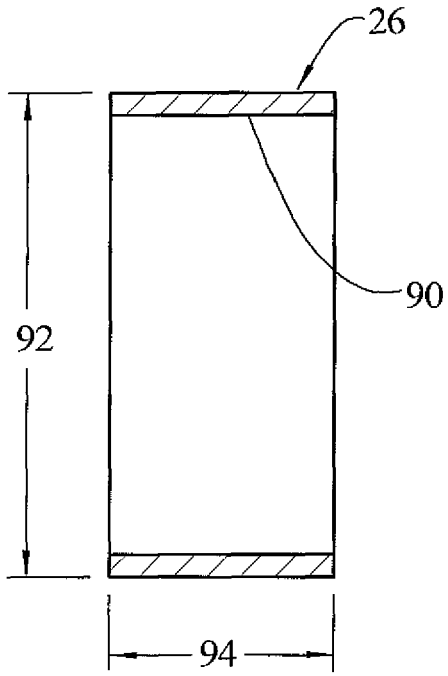
FIG. 6 is a side sectional view of the outer sleeve portion of the socket assembly of FIG. 1.
Figure 7:
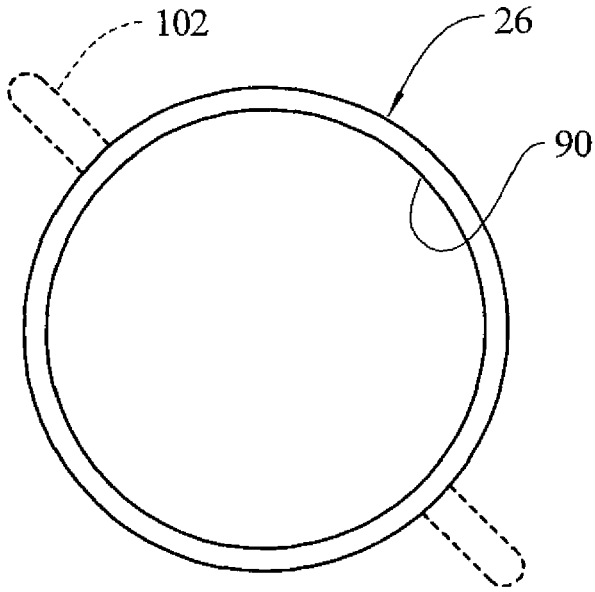
FIG. 7 is an end view of the outer sleeve.
Figure 8:
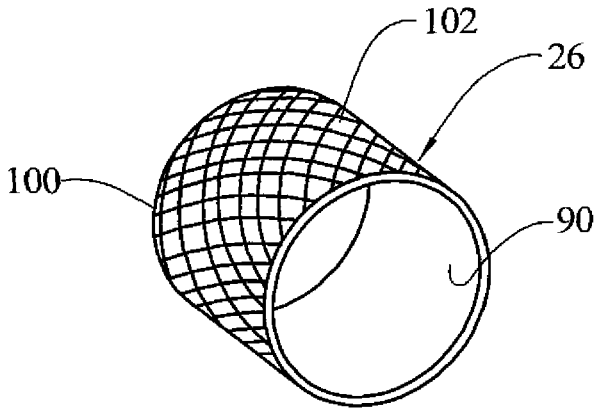
FIG. 8 is a front perspective view of the outer sleeve of FIG. 7.

A third abutment element 82, 82' may be fixed relative to the inner sleeve 24 engageable with the first abutment element 60, 60', such that the inner sleeve is rotatable on the socket 22 in a first rotational direction moving the third abutment element away from the first abutment element, but the inner sleeve is prevented from rotating in a second rotational direction once the third abutment element engages the first abutment element. In the embodiment illustrated, the third abutment element 82, 82' would comprise a second radially extending end wall of the groove 68, 68'. The pins 60, 60' when engaged against the second end walls 82, 82', would prevent the inner sleeve 24 from rotating further in a counter-clockwise direction (as seen in FIG. 4), however, the inner sleeve would be permitted to rotate in a clockwise direction resulting in a relative movement of the pin away from the second end wall. The spring 80, 80' would compress as the inner sleeve 24 is rotated clockwise relative to the socket 22. As this occurs, the non-circular opening 42 in the inner sleeve 24 will move into alignment with the non-circular opening 28 in the socket 22, permitting the socket and inner sleeve to be inserted over a nut.

The outer sleeve 26 surrounds at least a portion of the inner sleeve 24 in the area of the groove 68 receiving the elastic element 80 and the pin 60. The outer sleeve may have a circular cylindrical inner surface 90 with a fourth, inner diameter 92 sized to interferingly engage the inner sleeve outer surface 52. If the inner sleeve 26 has a non-circular outer surface, the inner surface of the outer sleeve would correspond to at least a portion of that shape. The outer sleeve 26 has an axial length 94 which may be substantially identical to the inner sleeve axial length 56. The outer surface 52 of the inner sleeve 24 may be knurled in at least a portion of an area 96 which is covered by the outer sleeve 26 in order to increase the frictional engagement between the inner sleeve and the outer sleeve. In this manner, the inner sleeve 24 and the outer sleeve 26 will co-rotate without the use of separate fastening elements engaged between these two parts. In other embodiments, fastening elements may be used to secure the inner sleeve 24 to the outer sleeve 26 to prevent relative rotation therebetween. In the embodiment illustrated, the outer surface 52 of the inner sleeve 24 is knurled in the area 96 extending substantially circumferentially around the inner sleeve outer surface, although in other embodiments, the knurling may be provided in discontinuous areas arranged around the circumference of the inner sleeve.

The outer sleeve 26 includes an outer surface 100 which may be configured to be manually graspable. This will allow a user to grasp the outer sleeve 26 and rotate it relative to the socket 22. As this occurs, the inner sleeve 24 will co-rotate with the outer sleeve 26, causing the non-circular opening 48 in the inner sleeve to rotate relative to the non-circular opening 28 in the socket. In order to facilitate the rotation of the outer sleeve 26, the outer surface 100 may have a feature 102 to enhance the manual graspability of the outer surface. In an embodiment, the feature 102 may comprise a knurling provided on the outer surface 100 of the outer sleeve 26. In another embodiment, the feature 102 may comprise a non-circular shape for the outer surface 100 of the outer sleeve 26.

In a preferred embodiment all of the components of the socket assembly are permanently assembled together such that no components can become detached from one another. The socket 22 is permanently held in the inner sleeve 24 by the pin 60, the spring 80 is held in the groove 68 by the covering of the outer sleeve 26 over the inner sleeve, and the outer sleeve is frictionally secured to the inner sleeve. As such, all of the components are secure and the unintentional separation of any of the components from the others is prevented.

In operation, particularly of the embodiment of the device illustrated in the FIGS., a user selects a socket 22 which will engagingly receive the nut 39 that is to be tightened onto or loosened from a bolt or threaded stud. The user will rotate the outer sleeve 26 relative to the socket 22 to align the non-circular opening 48 in the inner sleeve 24 with the non-circular opening 28 in the socket. The socket assembly 20 can then be inserted over the nut 39. When the outer sleeve 26 is released by the user, the side walls of the nut 39 will retain the non-circular openings 28, 48 in alignment. If the nut 39 is being inserted onto the bolt or stud, the nut may move all of the way into the non-circular opening 28 in the socket 22, and past the non-circular opening 48 in the inner sleeve 24. As this occurs, the spring 80 will cause the inner sleeve 24 to rotate relative to the socket 22, causing the non-circular openings 28, 48 to rotate into misalignment (as shown in FIG. 1), thereby capturing the nut 39 in the non-circular opening of the socket and preventing the nut from unintentionally dislodging from the socket. The nut 39 may then be inserted onto the bolt or stud and rotated into a nearly tight or fully engaged position. At that point, the user will again rotate the outer sleeve 26 relative to the socket 22 to realign the non-circular openings 28, 48, allowing the socket assembly 20 to be moved axially relative to the nut 39 so that the non-circular opening on the inner sleeve 24 will engage with the side walls of the nut, permitting the nut to be tightened further into full engagement with the bolt or stud.

Figure 10:
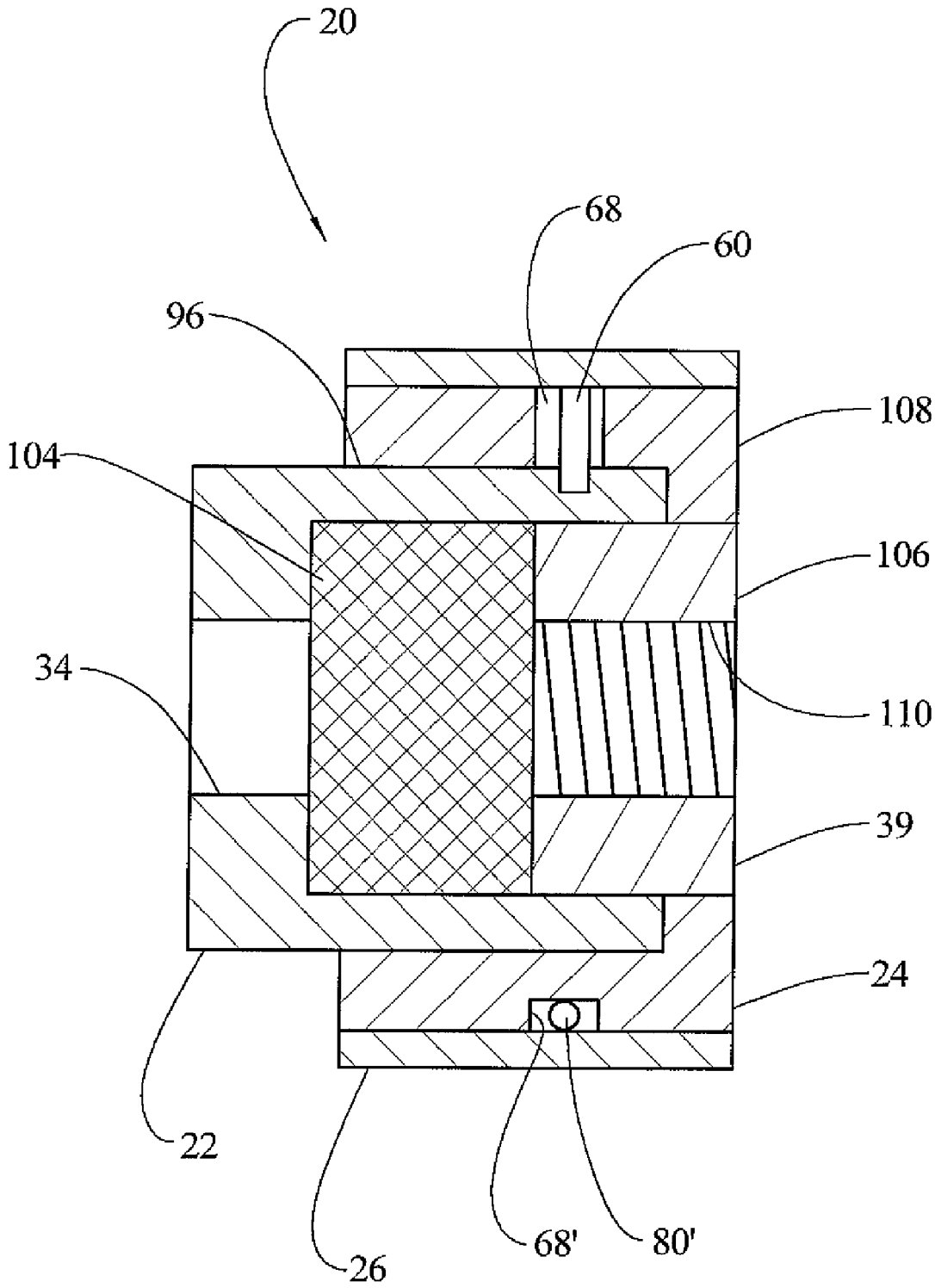
FIG. 10 is a side sectional view of the socket assembly of FIG. 1 and a captured nut in a second embodiment.

Alternatively, the nut 39 may be inserted less than all of the way into the non-circular opening 28, such as by the insertion of a filler 104 first being inserted into the socket 22, and then the nut being inserted as shown in FIG. 10. The filler 104, which can be made of steel, plastic, or other materials, can be sized such that the nut 39 will have its front face 106 flush with a front face 108 of the inner sleeve 24. In this manner the threaded opening 110 of the nut 39 will be easily accessible for insertion onto the bolt or stud, allowing easy start for the nut. The spring loaded inner sleeve 24 and its non-circular opening 28 will press against the non-circular outer surface of the nut 29, securely holding the nut within the socket assembly 20.

Figure 9:
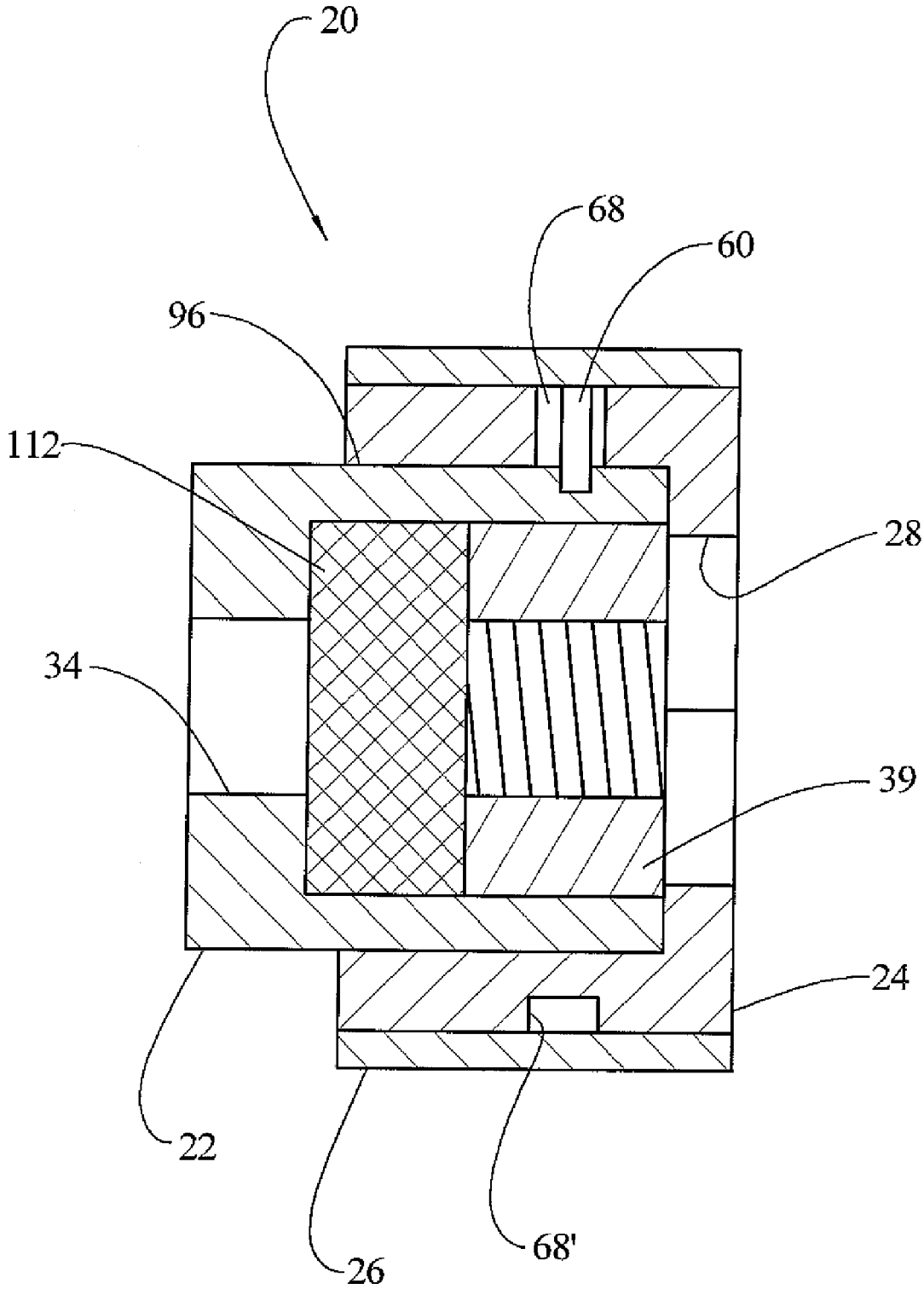
FIG. 9 is a side sectional view of the socket assembly of FIG. 1 and a captured nut.

To remove the nut 39 from the bolt or stud, the large filler 104 is removed and is either replaced with a smaller filler 112, as shown in FIG. 10, or no filler is used. The user then rotates the outer sleeve 26 relative to the socket 22 to align the non-circular openings 28, 48. The socket assembly 20 is then inserted over the nut 39 and the nut is rotated by rotating the socket 22, such as with a driving tool. As the nut 39 moves away from full engagement on the bolt or stud, the end wall 56 of the inner sleeve 24 will move below the end of the nut and the spring 80 will cause the inner sleeve to rotate relative to the socket 22, causing the non-circular openings 28, 48 to rotate into misalignment, thereby capturing the nut in the non-circular opening of the socket and preventing the nut from unintentionally dislodging from the socket (as shown in FIG. 9).

In embodiments where the non-circular openings 28, 48 are hex shaped openings, the inner sleeve 24 may be arranged to rotate approximately 30 degrees relative to the socket 22, which will cause the flat walls 114 of the inner sleeve non-circular opening 48 to lie perpendicularly across the vertexes 116 of the socket non-circular opening 28 (as shown in FIG. 1). The length of the groove 68 and the size of the spring 80 can be adjusted to provide this amount of movement. When other shapes of the non-circular openings are selected, other angles of relative movement can be selected to effect the capturing of the nut 39 within the socket 24 when the inner sleeve 26 rotates relative to the socket.

In other embodiments of the invention, other arrangements can be provided for capturing and securing the nut 39 within the socket 22, even when the non-circular opening 48 in the inner sleeve 26 is in alignment with the non-circular opening 28 in the socket. For example, a magnet may be provided in the socket 22 to hold nuts 39 made of magnetizable materials, or friction enhancing elements may be incorporated in the socket to engage nuts received therein.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A nut capturing socket assembly comprising:

a socket having a non-circular shaped interior opening and a circular cylindrical outer surface area with a first, outer diameter, an inner sleeve having a circular cylindrical opening at one end of the sleeve with a second, inner diameter sized to slidingly receive the circular cylindrical outer surface area of the socket and a non-circular shaped opening at an opposite end of the sleeve of substantially the same size and configuration as the non-circular shaped interior opening of the socket, the inner sleeve having an outer surface, a first abutment element fixed relative to the socket, a second abutment element fixed relative to the inner sleeve, an elastic element positioned between the first and second abutment elements, and an outer sleeve surrounding at least a portion of the inner sleeve in the region of the elastic element and having an inner surface sized to interferingly engage with a portion of the inner sleeve outer surface.

2. A nut capturing socket assembly according to claim 1, wherein the inner sleeve has an axial length and the outer sleeve has an axial length substantially identical to the inner sleeve axial length.

3. A nut capturing socket assembly according to claim 1, wherein the non-circular shaped opening in the inner sleeve is formed in an end wall of the inner sleeve, the end wall having a thickness of not more than 0.5 inches.

4. A nut capturing socket assembly according to claim 1, wherein the inner sleeve has an axial length and the socket has an axial length greater than the inner sleeve axial length.

5. A nut capturing socket assembly according to claim 1, wherein the interior opening of the socket is hexagonally shaped.

6. A nut capturing socket assembly according to claim 1, including a third abutment element fixed relative to the inner sleeve and engageable with the first abutment element, such that the inner sleeve is rotatable on the socket in a first direction moving the third abutment element away from the first abutment element, but the inner sleeve is prevented from rotating in a second direction once the third abutment element engages the first abutment element.

7. A nut capturing socket assembly according to claim 1, wherein the first abutment element comprises a projection extending radially out from the outer surface of the socket.

8. A nut capturing socket assembly according to claim 1, wherein the second abutment element comprises a radially extending wall formed in the inner sleeve.

9. A nut capturing socket assembly according to claim 8, wherein the radially extending wall comprises an end wall of a groove formed in the outer surface of the inner sleeve.

10. A nut capturing socket assembly according to claim 1, wherein the outer surface of the inner sleeve is knurled in an area covered by the outer sleeve.

11. A nut capturing socket assembly according to claim 10, wherein the outer surface of the inner sleeve is knurled in an area extending substantially circumferentially around the inner sleeve outer surface.

12. A nut capturing socket assembly according to claim 1, wherein an outer surface of the outer sleeve is configured to be manually graspable.

13. A nut capturing socket assembly according to claim 12, wherein the outer surface of the outer sleeve is provided with a knurling.

14. A nut capturing socket assembly according to claim 12, wherein the outer surface of the outer sleeve is provided with a non-circular shape.

15. A nut capturing socket assembly comprising:

a socket having a non-circular shaped interior opening and a circular cylindrical outer surface with a first, outer diameter, an inner sleeve having a circular cylindrical opening at one end of the inner sleeve with a second, inner diameter sized to slidingly receive the first, outer diameter of the socket and a non-circular shaped opening at an opposite end of the inner sleeve substantially the same size and configuration as the non-circular shaped interior opening of the socket, the inner sleeve having an outer surface, the inner sleeve outer surface including at least one groove formed therein extending in a circumferential direction, at least a portion of the groove having a depth equal to a thickness of the inner sleeve, a pin extending into a blind hole in the socket and into the groove, a spring carried in the groove to abut against one end of the groove at one end and to abut against the pin at the other end, and an outer sleeve surrounding at least a portion of the inner sleeve in the area of the groove and having an inner surface sized to interferingly engage the inner sleeve outer surface.

16. A nut capturing socket assembly according to claim 15, wherein the groove extends around less than half of the circumference of the outer surface of the inner sleeve.

17. A nut capturing socket assembly according to claim 15, wherein two grooves are provided, the two grooves extending circumferentially around less than one half of the circumference of the outer surface of the inner sleeve and generally lying in the same plane with each other.

18. A nut capturing socket assembly comprising:

a socket having a hexagonally shaped interior opening and a circular cylindrical outer surface with a first, outer diameter, an inner sleeve having a circular cylindrical opening at one end with a second, inner diameter sized to slidingly receive the first, outer diameter of the socket and a hexagonally shaped opening at an opposite end of substantially the same size as the hexagonally shaped interior opening of the socket, the inner sleeve having a circular cylindrical outer surface with a third, outer diameter, the inner sleeve outer surface being knurled in an area extending substantially circumferentially around the inner sleeve outer surface, the inner sleeve outer surface including two grooves formed therein each groove extending in a circumferential direction around less than one half of a circumference of the inner sleeve, both grooves lying generally in the same plane, a portion of each groove having a depth equal to the thickness of the inner sleeve, a pin extending into a blind hole in the socket and into the portion of the groove, a spring carried in the groove to abut against one end of the portion of the groove at one end and to abut against the pin at the other end, and an outer sleeve surrounding the inner sleeve and having a circular cylindrical inner surface with a fourth, inner diameter sized to interferingly engage the knurled outer surface area of the inner sleeve.

* * * * *